United States Patent [19]

Hartung

[11] Patent Number: 4,637,579

[45] Date of Patent: Jan. 20, 1987

[54] RAILROAD SWITCH MECHANISM

[75] Inventor: Russell M. Hartung, Webster, N.Y.

[73] Assignee: General Signal Corporation, Stamford, Conn.

[21] Appl. No.: 726,913

[22] Filed: Apr. 23, 1985

Related U.S. Application Data

[63] Continuation of Ser. No. 465,402, Feb. 10, 1983, abandoned.

[51] Int. Cl.[4] ..... E01B 7/00

[52] U.S. Cl. ..... 246/452; 246/404; 403/393; 403/355; 403/80

[58] Field of Search ..... 246/393, 400, 401, 404, 246/430, 449, 450, 452, 415 R; 403/393, 339, 341, 354, 379, 324, 378, 319, 318, 355, 388, 80, 109, 363, 364; 248/551, 552

[56] References Cited

U.S. PATENT DOCUMENTS

| | | | |
|---|---|---|---|
| 864,329 | 8/1907 | North | 403/109 X |
| 1,056,888 | 3/1913 | Davidson | 246/404 X |
| 1,141,907 | 6/1915 | Anderson | 246/404 X |
| 2,293,303 | 8/1942 | Morley | 248/551 |
| 2,515,624 | 7/1950 | Abernathy | 246/452 |
| 2,823,404 | 2/1958 | Hyman | 403/354 |
| 3,552,775 | 1/1971 | Warner | 403/378 X |

*Primary Examiner*—David A. Scherbel
*Assistant Examiner*—Glenn B. Foster
*Attorney, Agent, or Firm*—Ronald Reichman; Martin LuKacher

[57] ABSTRACT

A railroad switch mechanism wherein the switch points of a track switch are moved between normal and release positions by a switch machine connected to the switch points by throw rod, lock rod and detector rod assemblies which are adjusted to have predetermined lengths. The lock or detector rod assemblies have couplings which enable temporary disconnection from the switch points when testing to verify whether the operation of the switch to normal and reverse positions is within an allowable range of variations with respect to the stock rails with which the track switch is associated without affecting the adjustment of the length of the assemblies and requiring long and costly readjustment after the completion of testing.

7 Claims, 7 Drawing Figures

RAILROAD SWITCH MECHANISM

This is a continuation of application Ser. No. 465,402, filed Feb. 10, 1983, now abandoned.

DESCRIPTION

The present invention relates to railroad switch mechanisms, and particularly to connections between the track switch and the switch machine for facilitating verification testing of the detector mechanism of the switch machine.

The invention is especially suitable for use in providing connections between the locking mechanisms or the detector mechanisms of the switch machine which mechanisms are known as the lock connector rod and detector connector rod. These mechanisms are connected between the switch points and the control bars of the switch machine. These bars in the switch machine operate the detecting and locking functions thereof.

In order that the detecting and locking functions are properly performed so that the switch machine is locked when the track switch is in normal position to allow the train to travel straight ahead or in reverse position to allow the train to turn out from the main line, the lock rods must be precisely adjusted to the length necessary to accommodate the distance between the switch points and the switch machine. Similarly, the detector rod must be precisely adjusted in length so as to enable it to control the detector mechanism which controls the position of electrical switch contacts, the state of which (open or closed) indicates the position of the track switch whether in normal, reverse or some intermediate position.

For many mainline railroad switch machines, a monthly inspection by governmental authorities (the Federal Railroad Administration in the United States) is required. One of the items of this inspection is verification that a ¼" movement of the switch points will be detected and the electrical switch contacts of the detector mechanism set to condition the train signals to a restrictive mode which will warn oncoming trains and the dispatcher in the control tower that the track switch is not fully over to normal or reverse position. This test simulates, or may be actually performed by placing, a ¼" obstruction into the track switch so that it cannot close fully and then verifying that the switch machines detector circuits show an open track switch (restrictive signal indication).

This test has been time consuming and laborious since, when the track switch is held open the required ¼", the switch machine is prevented by the locking rod from operating to the detect position where the detector mechanism is enabled to operate. In order to perform the test, the detector or lock rod assemblies have, heretofore, been disassembled, thereby losing their precise adjustment. After the test is completed these assemblies must be readjusted by trained crews who use gauges so as to assure that the precise length adjustment is restored.

It is the object of the present invention to provide improved railroad switch mechanisms which facilitate the performance of testing to verify the adjustment thereof and especially such verification testing as is required by governmental regulations.

It is another object of the present invention to provide an improved railroad switch mechanism wherein costly and time consuming readjustments after verification testing is avoided.

It is a further object of the present invention to provide an improved railroad switch mechanism which enables decoupling of control assemblies, such as control bars, which govern operation of the detector mechanism in the switch machine, from the moveable switch points to facilitate testing of the detector mechanism without need for readjustments upon completion of testing.

It is a still further object of the present invention to provide an improved railroad switch mechanism with improved couplings in the lock bar/rod or in the detector bar/rod assemblies thereof which control the detector mechanism of the switch machine so as to facilitate governmentally required, periodic testing of the operation of the detector mechanism to verify whether the operation of the track switch to normal and reverse positions within the allowable range of variations with respect to the stock rails is being detected and to avoid the need to readjust these assemblies after such testing.

Briefly described, a control mechanism for a railroad switch mechanism having a switch machine connected to a railroad track switch via the control mechanism which embodies the invention makes use of means moveable with the switch points of the track switch for providing a rigid connection between the switch machine and the switch points of adjustable length. Coupling means in the moveable means has an opening. A member is removeable from and replaceable into the opening for releasing the connection without affecting the adjustment of the connection upon replacement of the member in the opening. The coupling provides a sliding joint, which in the case of the lock connector rod enables the locking bar to be adjusted to permit the switch machine to operate to the detect position. In the case of the detector rod, movement of the rod will simulate the ¼" obstruction and test for the operation of the detector mechanism.

The foregoing and other objects, features and advantages of the invention will become more apparent from a reading of the following description in connection with the accompanying drawings in which.

Figure 1:
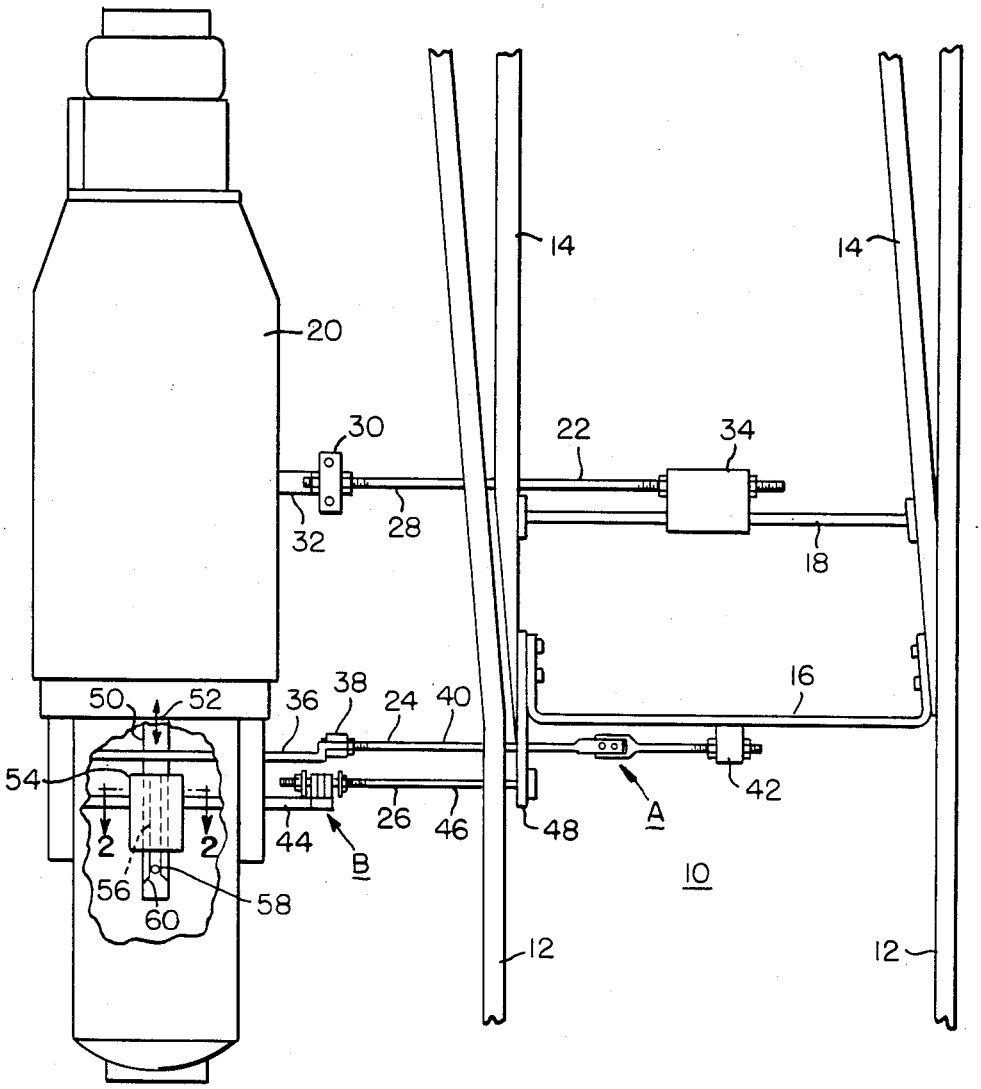
FIG. 1 is a plan view, diagramatically showing a railroad switch mechanism which embodies the invention.

Referring more particularly to FIG. 1, there is shown a track switch 10 having stock rails 12 and switch points 14 shown in the reverse position. Front rod 16 and second rod 18 interconnect the switch points. The switch points are operated by a switch machine 20 which may be any power operated switch machine, such as the model 5G which is manufactured by the General Railway Signal Company of Rochester, N.Y. The switch machine 20 is connected to the switch points 14 by control assemblies, namely a throw rod assembly 22, a lock rod assembly 24 and a detector rod assembly 26. The throw rod assembly 22 has a throw rod 28 connected at one end by a lug 30 to the throw bar 32 of the switch machine 20. The other end of the throw rod 28 is connected by a throw rod connector 34 to the second rod 18 connecting the switch points 14. The lock bar 36 of the switch machine is connected by means of a lug 38 to one end of the lock rod 40 of the lock rod assembly 24. The other end of the lock rod 40 is connected by a connector lug 42 to the front rod 16 of the switch points 14. The detector bar 44 of the switch machine 20 is connected by the coupling indicated at B to the connector rod 46 of the detector rod assembly 26 and then to a point detector attachment rod 48 which is connected to the switch points 14.

The effective length of the throw rod assembly 22, the lock rod assembly 24 and the detector rod assembly 26 is precisely adjusted and set for the requisite distances between the switch machine 20 and the switch points 14 by means of threaded ends on the throw rod 28 and the lock connector rod 40 and detector connector rod 46. These ends extend through openings in the lugs and connectors which are attached to the throw bar 32, the lock bar 36 and the detector bar 44. The far end of the throw rod is threaded and is connected to the throw rod connector 34 by nuts which also provide for the adjustment. Similar threaded ends on the lock rod connector 42, as well as on the point detector attachment rod 48, also provide for their adjustment. Nuts bearing against these lugs and connectors lock the rods in place and the requisite adjustment of their lengths.

The switch machine 20 has, as is conventional, a cam or plunger bar 50 which is reciprocated in the direction of the arrows 52 by the motor driven mechanism which drives the throw rod 28 in the direction longitudinally thereof which direction is toward and away from the switch points 14. When the switch points are in reverse or in normal position, a dog on the cam bar 50 is locked by notches or grooves in the lock bar 36 which align themselves with the dog on the cam bar 50 so as to prevent the lock bar 36 and therefore the switch mechanism including the throw bar 32 from moving. This locks the switch points 14 in their normal or reverse position.

The switch machine 20 is also provided with a detector mechanism 54 having a movement which is pivotally mounted on a shaft 56 so as to open and close electrical switches. These switches are not shown in FIG. 1. The movement has a wheel 58 which is received in a channel 60 in the cam bar 50. Unless the cam bar is moved a sufficient distance to bring the switch points 14 to either their open or closed position, the wheel 58 remains in the channel 60 and prevents the movement 54 from pivoting and allowing the electrical point detector switches to be operated. The pivoting of the movement 54 is also controlled by the longitudinal position of the detector bar 44 which, in turn, is controlled by the position of the switch points 14 as translated through the detector connector rod 46. If, however, the switch points are not fully in their normal or reverse positions, the lock rod assembly 24 prevents the lock bar 36 from moving to a position where the channel 60 and the cam bar 50 clears the wheel 58 and allows the detector movement 54 to pivot so as to render the point detector operative.

Inasmuch as the testing of the operation of the point detector mechanism is predicated upon a ¼" obstruction between a stock rail 12 and one of the switch points 14, the verification of the operation of the point detector mechanism cannot be carried out unless the lock rod assembly 24 is somehow shortened or lengthened to enable the dog in the cam bar 50 to clear the notch in the lock bar 36. Alternatively, with the cam bar 50 operated to the position it achieves with the switch points in their normal or reverse positions, the detector rod assembly 26 must be effectively shortened or lengthened to simulate a ¼" obstruction between the switch points and the stock rails. In order to provide such shortening or lengthening either in the case of the lock rod assembly 24 or the detector rod assembly 26, the adjusting nuts on the ends of the rods 40 or 46 must purposely be misadjusted. Then, after the test is finished, the assemblies 24 or 26 must be completely readjusted and realigned. This is a time consuming and laborious task which must be performed by skilled personnel with the aids of jigs and gauges or the like.

Figure 2:
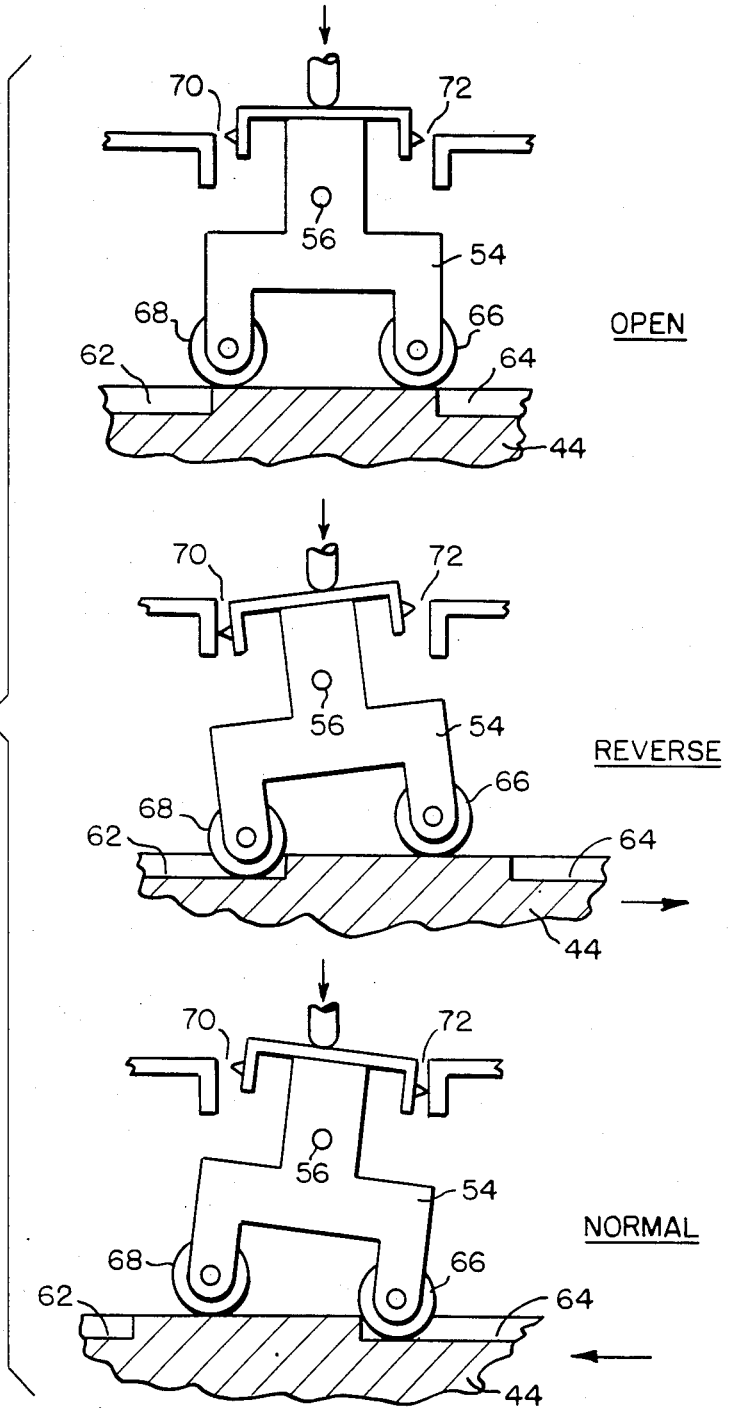
FIG. 2 is a schematic diagram of the detector mechanism of the switch machine shown in FIG. 1, the view being taken generally along the line 2—2 in FIG. 1 showing the detector mechanism in positions where the track switch is in normal, reverse and switch open positions.

FIG. 2 shows, schematically, how the detector bar 44 controls the detector movement 54. The detector bar 44 has notches 62 and 64 which receive rollers 66 and 68. The electric switch contacts 70 and 72 are made and broken depending upon the tilting of the movement 54. The detection of the switch points, in the normal position occurs when the contacts 72 close. The closure of the contacts 70 indicates that the switch points 14 are in the reverse position. If the movement 54 is constrained by the wheel 58 being in the channel 60 of the cam bar 50, the switch point detector contacts will not tilt, and thus indicate that the track switch is in the open position. The same result would, of course, be obtained if there was an actual ¼" obstruction, since then the cam bar would not move sufficiently to allow the movement to tilt. Accordingly, unless the cam bar is actuated to a position which corresponds to the fully reverse or fully normal positions of the track switch, the verification of the point detector mechanism cannot be obtained. It will be appreciated that the springs in the switch machine which bias the movement 54 against the detector bar 44 are not shown. Also, the movement 54 may have several sets of rollers each operating into different notches in a compound detector bar assembly as may be used in conventional switch machines.

In order to enable the verification of the proper operation of the switch machine to be determined without effecting the adjustment of the assemblies 24 and 26, either the lock rod assembly 24 or the detector rod assembly 26 may be provided with a coupling which enables the lock bar 36 or the detector bar 44 to be moved longitudinally a sufficient distance to perform the verification testing without affecting the adjustment of these assemblies. The lock rod assembly 24 and the detector rod assembly 26 are mechanisms which are moveable with the switch points and provide a rigid connection between the switch machine and the switch points. These connections may be decoupled by coupling means indicated at A and B in FIG. 1. Both coupling means A for the lock rod assembly 24 and B for the detector rod assembly 26 are not used in the same installation. It may be preferable, since the crews which perform the verification test more often loosen the lock rod assembly than the detector rod assembly, for the coupling A in the lock rod assembly to be used rather than the coupling B in the detector rod assembly. Moreover, there may be protective coverings close to the switch machine which in some switch machines may make the installation of the coupling B in the detector rod assembly 26 more difficult to install and to operate.

Figure 3:
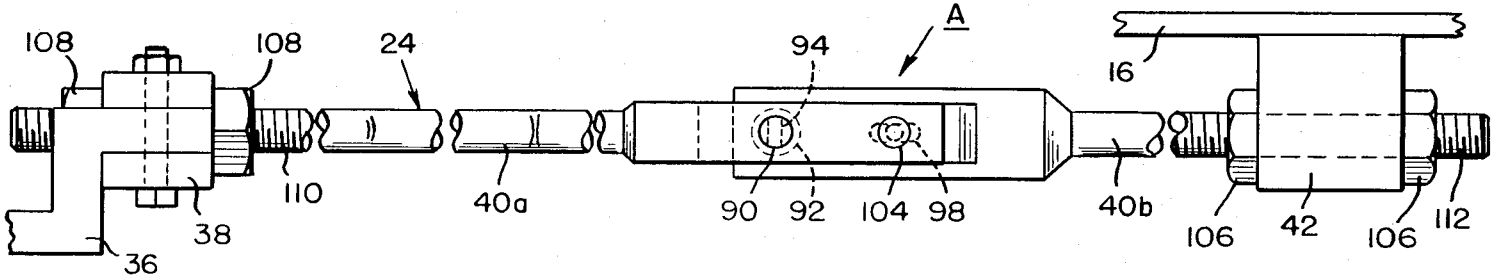
FIG. 3 is a plan view of a lock, connector rod assembly indicated generally by the arrow marked with the letter A in FIG. 1.
Figure 4:
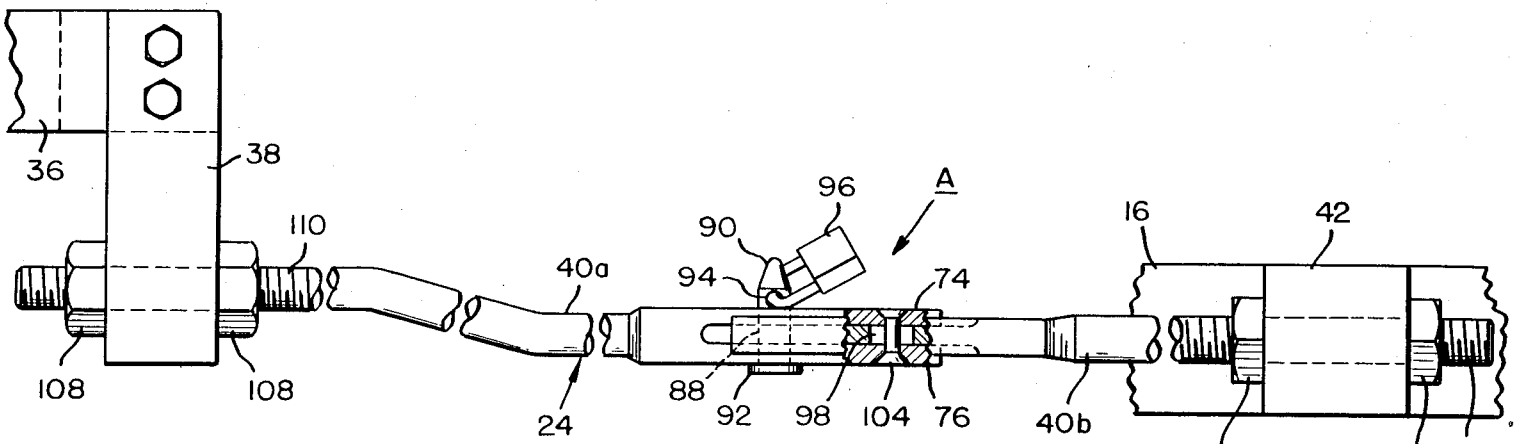
FIG. 4 is a front view of the assembly shown in FIG. 3.
Figure 5:
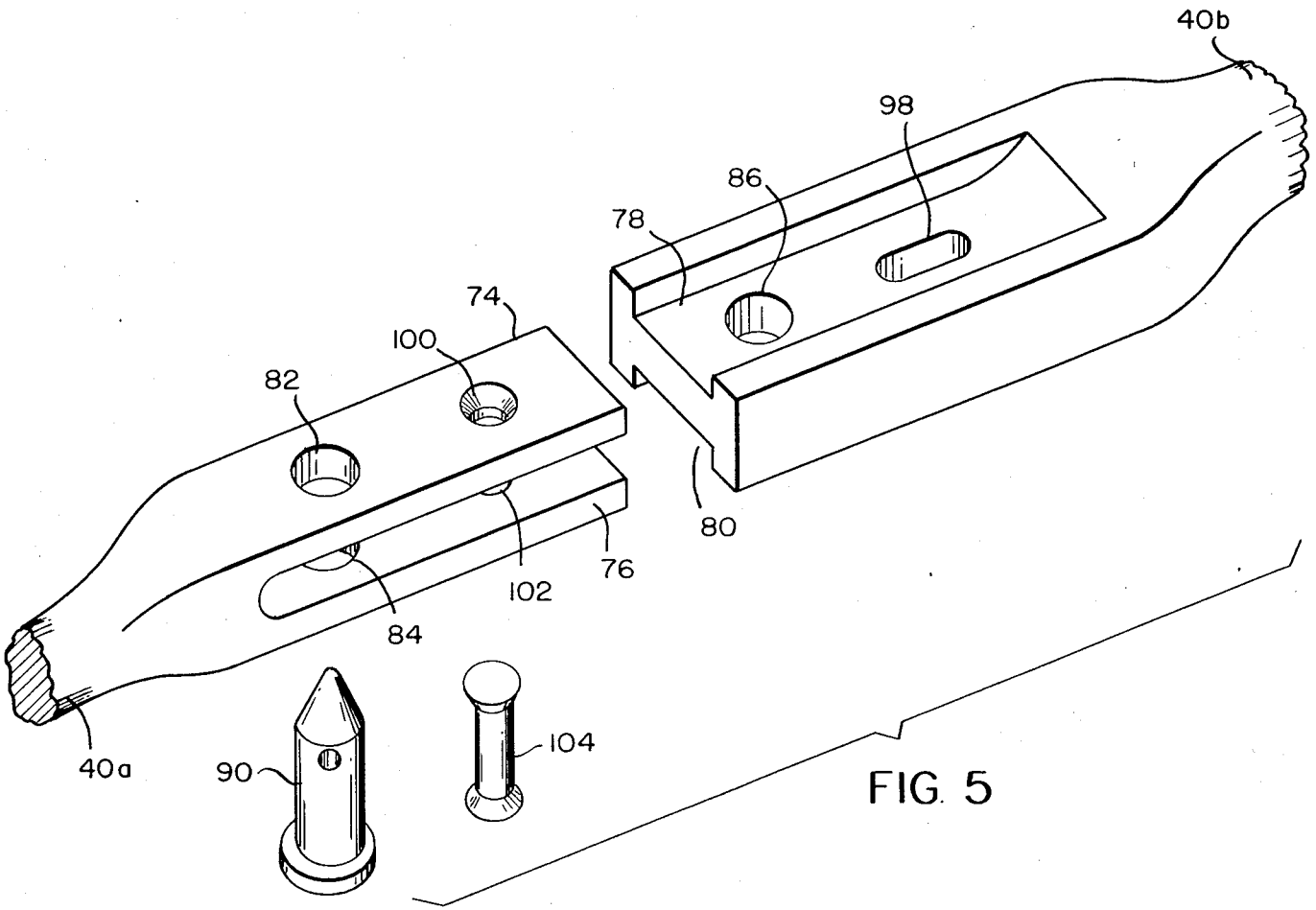
FIG. 5 is an exploded view showing the sliding joint coupling of the assembly shown in FIGS. 3 and 4.

In FIGS. 3–5, the coupling A is shown in greater detail together with the lock rod assembly 24 and the lugs 38 and 42 which attach the ends of the lock rod assembly 24 to the front rods 16 and the lock bar 36, respectively.

The lock connector rod 40 has two parts 40*a* and 40*b*. The coupling A interconnects the ends of these parts 40*a* and 40*b*. One of these interconnecting ends is bifurcated and has two fingers 74 and 76. The interconnecting end of the other part 40*b* is received between these fingers and has longitudinal grooves 78 and 80 into which the fingers 76 and 74 fit. The interconnecting ends have holes 82, 84 and 86 of like diameter which line up to form a through hole 88 into which a pin 90 is releaseably inserted. The pin 90 may have a head 92 and a hole 94. The pin may be locked in place by a lock 96 shown in FIG. 4. The diameter of the pin is approximately equal to the diameter of the hole 88 so as to preserve the rigid connection provided by the lock rod assembly 24.

In order to enable the parts 40*a* and 40*b* of the assembly 24 to move with respect to each other and thereby allow the lock bar 36 to clear the dog in the cam bar 50, as described above, the grooved end of the lock rod part 40*b* is provided with a slot 98, for example, about ¾" long. In alignment with this slot are holes 100 and 102 in the fingers 74 and 76 of the bifurcated end of the lock rod part 40*a*. A fastener such as a rivet 104 is permanently attached in the fingers and extends through the slot 98.

When the verification test is to be performed, the pin 90 is removed. The lock rod part 40*a* near the switch machine then can be adjusted by hand so as to make the lock bar 36 clear the cam bar 52. After the testing is completed the pin 90 is reinserted in the opening 88 provided by the aligned holes 82, 84 and 86 and locked in place. The adjustment and alignment of the lock rod assembly as provided by the nuts 106 which bear against the connector lug 42 and the nuts 108 which bear against the lug 38 is preserved. It will be noted that these lugs receive the threaded ends 110 and 112 of the parts 40*a* and 40*b* of the lock connector rods.

Figure 7:
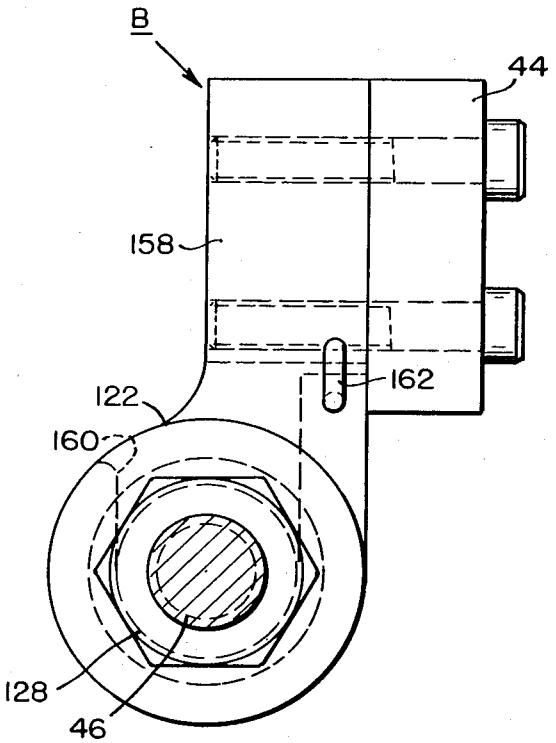
FIG. 7 is an end view of the slideable joint coupling shown in FIG. 6.
Figure 6:
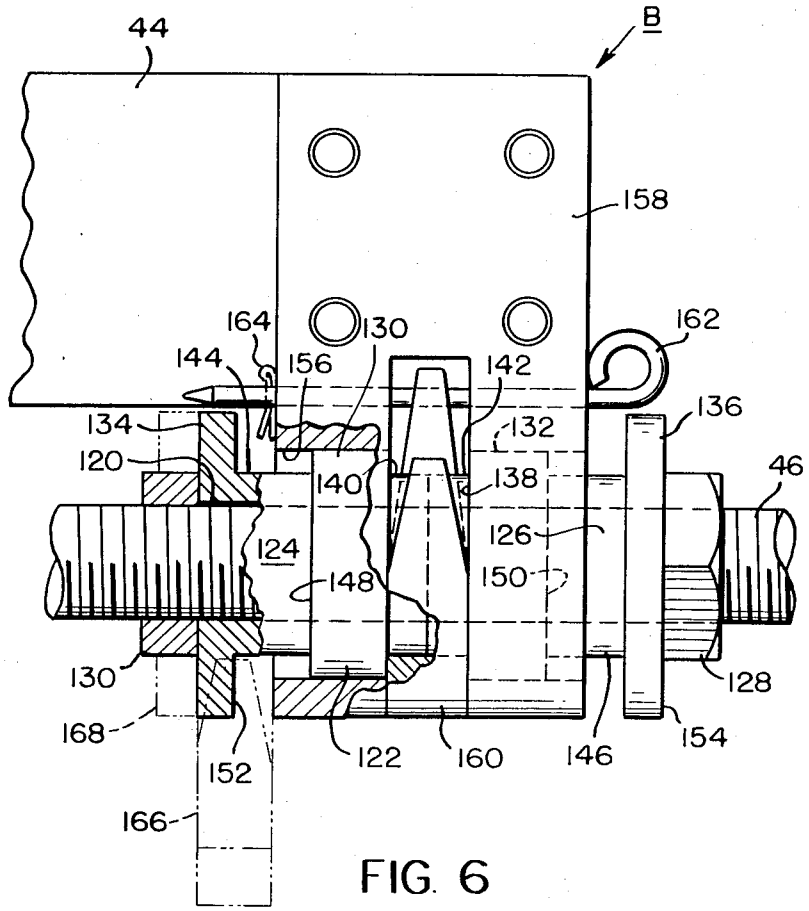
FIG. 6 is a front view of the slideable joint coupling of the detector, connector bar assembly indicated generally by the arrow marked with the letter B in FIG. 1.

Referring to FIGS. 6 and 7, there is shown the coupling B which may be used in the detector rod assembly 26. The end of the detector rod 26 is threaded and is inserted through an opening 120 in a collar 122. This collar has two parts 124 and 126 which are butted together and held in place on the threaded end of the detector rod 46 by nuts 128 and 130 which bear against the outer ends of the collar. The collar has inner rings 130 and 132 and outer rings 134 and 136. Opposing inner shoulders 138 and 140 of the inner rings 130 and 132 define a groove 142. Grooves 144 and 146 are defined between the outer shoulders 148 and 150 of the inner rings 130 and 132 and the inner shoulders 152 and 154 of the outer rings 134 and 136. In assembly of the coupling, each collar part 124 and 126 is inserted into a longitudinal hole 156 in a retaining lug 158 which is bolted to the detector bar 44. The diameter of the hole 156 is slightly larger than the diameter of the rings 130 and 132 so that the collar may slide longitudinally in the hole 156.

A retaining member 160 in the form of a hook is removably mounted onto the lug 158 and is held in place by a locking pin 162 which is located in a hole radially spaced from the longitudinal axis of the detector connector rod 46. This pin may be locked in place by another pin 164, for example, a cotter pin.

When the retaining hook 160 is in the inner groove 142 it connects the collar 122 to the retaining lug 158 and prevents relative movement of the collar and the detector connector rod 46. When testing of the point detector mechanism is desired, the pin 162 is removed. Then the hook retaining member 160 is also removed and placed in the groove 144 as shown by the dashed line position thereof at 166. This urges the collar and the connector rod to the left as shown in FIG. 6 to the position shown by the dashed lines 168. This movement simulates an obstruction between the stock rails and the switch points which prevents the switch points 14 from moving into the reverse position as shown in FIG. 1. The detection mechanism may then be tested for verification of the operation thereof for an obstruction between the near point (the switch point 14 closest to the switch machine as shown in FIG. 1). Similarly, removal and placement of the retaining member 160 in the groove 146 will simulate an obstruction between the far point (the switch point furthest from the switch machine 20) and the stock rail 12. The detector mechanism may then be tested to verify that it remains in the open position when such an obstruction exists. After testing the retaining member 160 is returned to the center or inner groove 142 and locked in place with the pin 162.

From the foregoing description it will be apparent that there has been provided improved railroad switch mechanisms which facilitate verification testing of the detection mechanism of switch machines. Variations and modifications in the herein-described mechanisms, within the scope of the invention, will, undoubtedly, suggest themselves to those skilled in the art. Accordingly, the foregoing description should be taken as illustrative and not in a limiting sense.

I claim:

1. A control assembly for a railroad switch mechanism having a switch machine and a railroad track switch connected thereto via said control assembly, which control assembly avoids the need for readjustments after testing, said control assembly comprising a rod assembly movable with said track switch and providing a rigid connection beween said track switch and said switch machine of adjustable length, coupling means in said rod assembly having an opening, a member removable from and replaceable in said opening for releasing said connection so that the adjustment of said connection established by said rod assembly upon replacement of said member in said opening is quickly reestablished thereby reducing the time required for testing to verify the operation of said track switch, said rod assembly being provided by a detector rod assembly, said detector rod assembly comprising a detector connector rod connected at one end thereof to the switch points of said track switch and via said releasing member to the detector bar of said switch machine, said coupling means including a collar having an annular groove defining said opening, said connector rod being connected to said collar, means retaining said collar in longitudinal sliding relationship therewith, and a replaceable retaining member disposed in said groove and engageable with said retaining means for releasing said collar and connector rod for sliding movement when removed from said groove and maintaining said rigid connection when disposed in said groove.

2. The invention according to claim 1 wherein said retaining member is a hook having a width approximately equal to the width of said groove.

3. The invention according to claim 2 wherein said hook is removably mounted on said retaining means by means of a pin connected to said hook at a point radially spaced from the longitudinal axis of said collar.

4. The invention according to claim 1 wherein said collar has second and third grooves longitudinally spaced from said first named groove on opposite sides thereof, said retaining member being disposable in said second groove and third groove when said detector connector rod and switch points are moved longitudinally in opposite directions toward and away from said switch machine by predetermined distances.

5. The invention as set forth in claim 4 wherein said retaining means is a lug connected to the detector bar of said switch machine, said lug having a longitudinal opening therethrough, said collar having rings longitudinally spaced from each other which defines shoulders of said grooves, inner shoulders of an inner pair of said rings defining said first groove and inner shoulders of an outer pair of said rings and outer shoulders of said inner pair of rings defining said second and third grooves, said outer rings being of greater diameter than said longitudinal opening in said lug and being spaced apart longitudinally a distance greater than the longitudinal dimension of said lug plus the width of said retaining member, said inner rings being approximately of the said diameter as said longitudinal opening in said lug.

6. The invention according to claim 5 wherein said collar has two parts having opposed ends between the outer rings thereof.

7. The invention according to claim 5 wherein the portion of said connector rod which extends to said collar is threaded, and nuts on said portion bearing against the opposite ends of said collar for adjusting the length of said rod between said switch points and said switch machine, and fixedly connecting said collar to said connector rod.

* * * * *